US008091302B2

(12) United States Patent
Meyer

(10) Patent No.: US 8,091,302 B2
(45) **Date of Patent: *Jan. 10, 2012**

(54) RAISED FLOOR ACCESS PANEL WITH INTEGRATED LEVELER

(76) Inventor: Gary Meyer, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/655,883

(22) Filed: Jan. 11, 2010

(65) Prior Publication Data

US 2010/0180520 A1 Jul. 22, 2010

Related U.S. Application Data

(62) Division of application No. 10/684,018, filed on Oct. 10, 2003, now Pat. No. 7,779,587.

(51) Int. Cl.
*E04B 5/48* (2006.01)
*E04B 5/02* (2006.01)

(52) U.S. Cl. ..... 52/263; 52/127.7; 52/126.5; 52/127.8

(58) Field of Classification Search ..... 52/263, 52/220.1, 220.2, 220.8, 126.1–126.4, 167.7
See application file for complete search history.

(56) References Cited

U.S. PATENT DOCUMENTS 1,646,725 A * 10/1927 Davidson ..... 52/690
3,511,001 A * 5/1970 Morgan, Jr. ..... 52/126.5
3,844,440 A * 10/1974 Hadfield et al. ..... 220/3.7
4,258,516 A 3/1981 Mori et al.
4,278,031 A * 7/1981 Dangschat ..... 108/4
4,348,841 A * 9/1982 Ueno et al. ..... 52/126.5
5,049,700 A * 9/1991 Kobayashi et al. ..... 174/482
5,052,156 A * 10/1991 Tanaka et al. ..... 52/126.6
5,072,557 A * 12/1991 Naka et al. ..... 52/126.6
5,074,085 A * 12/1991 Ueda ..... 52/126.6
5,123,776 A 6/1992 Lang et al.
5,301,480 A * 4/1994 Oyama et al. ..... 52/126.6
5,333,423 A * 8/1994 Propst ..... 52/126.6
5,389,737 A * 2/1995 Kobayashi et al. ..... 174/483
5,398,466 A * 3/1995 Oyama et al. ..... 52/126.6
5,459,968 A * 10/1995 Jin ..... 52/126.6
5,499,476 A * 3/1996 Adams et al. ..... 52/220.1
5,628,157 A * 5/1997 Chen ..... 52/263
6,672,022 B2 * 1/2004 Simmons ..... 52/263
6,857,230 B2 * 2/2005 Owen ..... 52/126.6
7,360,343 B1 4/2008 Spransy et al.
2002/0078638 A1 * 6/2002 Huang ..... 52/126.6
2008/0274685 A1 11/2008 DeJonge et al.

* cited by examiner

*Primary Examiner* — Phi D. A
(74) *Attorney, Agent, or Firm* — Scott L. Terrell, P.C.; Scott L. Terrell

(57) ABSTRACT

A floor panel plate has four corner portions, four lateral edge portions, an upper load bearing surface, a lower plenum surface, and a clear hole positioned adjacent to each of the corner portions. A threaded collar is vertically connected to the lower plenum surface and positioned in axial alignment with the clear hole. A single handed set screw has an upper tool receiving end and a lower foot end. The set screw engages the threaded collar so that the tool receiving end extends through the clear hole so that when operated the set screw adjusts the upper load bearing surface to a predetermined level in relation to the pedestal head of a pedestal support system.

11 Claims, 5 Drawing Sheets

RAISED FLOOR ACCESS PANEL WITH INTEGRATED LEVELER

CROSS REFERENCE TO RELATED APPLICATIONS

This is a divisional application of application Ser. No. 10/684,018, filed Oct. 10, 2003 now U.S. Pat. No. 7,779,587.

STATEMENT OF FEDERALLY SPONSORED RESEARCH

Not Applicable.

BACKGROUND OF THE INVENTION

1. Field of the Invention

The present invention relates to raised floor access panels. In particular it relates to an interchangeable floor panel having an integrated vertical leveler for retrofit applications with an existing raised access floor.

2. Description of the Related Art

Raised floors are commonly used to create a space between a sub-floor and the normal working environment of a room. The sub-floor is the surface that would serve as the floor of a data center prior to installation of a raised access floor. The space between the sub-floor and the raised access floor is used to contain electrical wiring and fiber optic cables, to contain an air plenum chase, and more generally to contain anything that must be in a room but is more safely or conveniently enclosed in an area apart from the main area of the data center room.

Although the primary purpose of a panel is to structurally support an applied load, they must also be easily and safely removed and re-inserted. This is required for the relocation of work cubicles, equipment, wiring, cabling and air flow disbursement to appropriate heat load designs.

When operating, data centers generate a great deal of revenue. Thus, it is very costly to shut down an entire facility, for months, in order to replace an entire floor system, with an entirely new system, having matching panels, pedestals and stringers due to the variance in specifications of different manufacturers. In dealing with this ever-growing-problem, what is needed is an adjustable raised floor panel which would be compatible with previously installed pedestal and stringer systems so that floor panel replacement can be performed on a panel-by-panel basis rather than to completely re-build the entire facility from the subfloor up. This concept would thereby save the industry an enormous amount of cost and time.

Thus, what is needed is a universal retro-fit raised access floor panel having an integral leveling mechanism so that it is capable of horizontal alignment with an existing raised access floor without changes to the existing pedestal support system and stringer matrix. It follows that the leveling mechanism should be operable through an opening in the panel top in order to level the floor vertically, up or down, in order to thereby eliminate the need to adjust each of the pedestal support members, or, more likely, the entire access floor. The present invention satisfies these needs.

BRIEF SUMMARY OF THE INVENTION

It is therefore an object of the present invention to provide a universal raised access floor panel having an integral leveling mechanism so that it is capable of vertical alignment to the plane of an existing raised access floor.

It is another object of the present invention to provide a raised access floor panel which is adjustable in height with respect to a pedestal head.

To overcome the problems of the prior art and in accordance with the purpose of the invention, as embodied and broadly described herein, briefly, a method for installation of a raised access floor panel with a raised access floor is provides which includes providing a pedestal support system having a plurality of vertically extending pedestal supports 1712 each having an upper end connected to a pedestal support head 38, 173 and a lower end connected to a pedestal support base 171. The pedestal support heads 38, 173 are each connected in a matrix orientation with a plurality of horizontal stringers 1719, 1718. A floor panel plate is provided having four corner portions, four lateral edge portions, an upper load bearing surface, a lower plenum surface, and a clear hole positioned adjacent to each of the corner portions. In this manner, the raised floor access panel is a substantially flat panel with an upper load supporting surface and a lower surface to be supported on the plurality of pedestal members 1712 each adjacent to a corner of the panel and a panel leveler is threaded through a hole in each corner of the panel for adjusting a distance between the panel and the pedestal heads 38, 173. A threaded collar is vertically connected to the lower plenum surface and positioned in axial alignment with the clear hole. The panel leveler is a set screw with an upper tool receiving end and a lower foot end. The set screw engages the threaded collar so that the tool receiving end extends through the clear hole. The upper load bearing surface adjusts to a predetermined level in relation to the pedestal head 38, 173 by rotating the set screw.

Additional advantages of the present invention will be set forth in part in the description that follows and in part will be obvious from that description or can be learned from practice of the invention. The advantages of the invention can be realized and obtained by the apparatus particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and, together with the description, explain the principles of the invention.

DETAILED DESCRIPTION OF THE DRAWINGS

Unless specifically defined otherwise, all technical or scientific terms used herein have the same meaning as commonly understood by one of ordinary skill in the art to which this invention belongs.

Although any methods and materials similar or equivalent to those described herein can be used in the practice or testing of the present invention, the preferred methods and materials are now described. Reference now will be made in detail to the presently preferred embodiments of the invention, examples of which are illustrated in the accompanying drawings, wherein like numerals represent like features.

Figure 1:
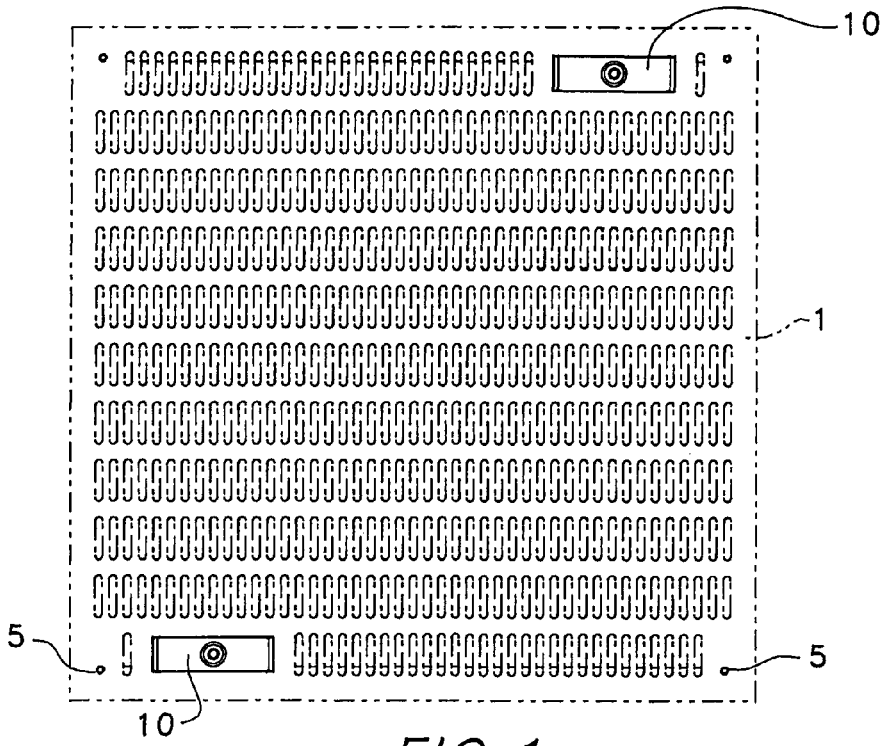
FIG. 1 is a top view of a perforated panel showing a preferred relationship to the panel lifters.
Figure 2:
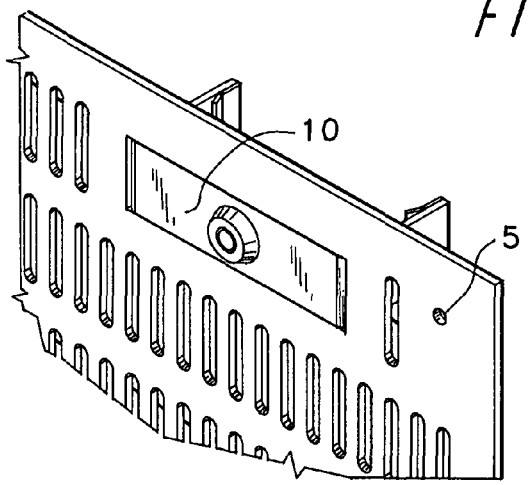
FIG. 2 is a perspective view of one embodiment of a panel lifter while locked in a closed position.
Figure 3:
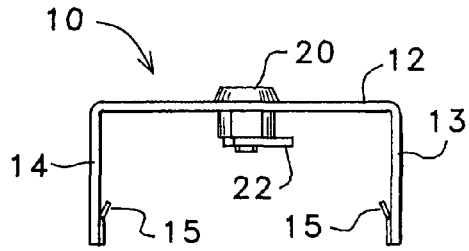
FIG. 3 is a side view of a panel lifter including one embodiment of the locking mechanism.
Figure 4:
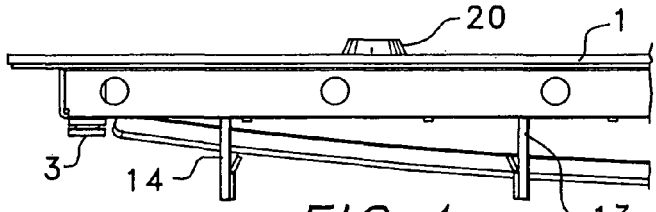
FIG. 4 is a side view of a panel lifter installed in a panel having the panel leveling mechanism in accordance with the present invention.

The invention provides a universal retro-fit raised access floor panel having an integral leveling mechanism so that it is capable of horizontal alignment with an existing raised access floor without making changes to the existing pedestal support system and stringer matrix. FIG. 1 is a top view of a perforated panel 1 showing a preferred arrangement of the integrated panel lifters 10 and panel levelers 5. As shown in FIGS. 2, 3, and 4, the panel lifters 10 include a top wall 12 and two side walls 13, 14. At the end of each side wall 13, 14 is a stop 15 which restricts the panel lifter 10 from traveling out of the panel 1 when removing or re-installing the panel in a floor matrix. As shown in the drawing figures, the panel lifter 10 may, but need not, include a locking mechanism 20. The first embodiment shown in these drawing figures is a key lock 20 centrally mounted in the top wall 12 of the panel lifter 10. The key locking mechanism 20 terminates in a locking tab 22 which, when the panel lifter top plate 12 is in a downward position substantially flush with a plate 30, attached to the underside of the panel with a rivet or weld, travels through a key shaped hole in the plate 36. The panel 1 is then locked to a pedestal 38 by inserting a key in the lock and turning the tab 22 against an underside of the plate 38 and removing the key.

Panel levelers 5 may, but need not, be provided at each corner of the panel 1 to adjust a distance between the pedestal head 38 and the underside-side of the panel. In this manner, the floor panel according to the present invention can be used to replace old or damaged panels of different thickness by adjusting the distance to a position where the panel top surface is on a plane with the existing raised floor panels of a different manufacture. The panel levelers are preferably a hex head threaded set screw connector (not shown) through a collar extending through the corner clear hole 5 in a corner of the panel. The panel leveler desirably includes a foot 3 for resting on the pedestal head 38. The foot 3 is adjustably moved in an upward or downward direction, relative to the panel, by turning a hex head driver through the hole 5 in the panel 1.

Figure 5:
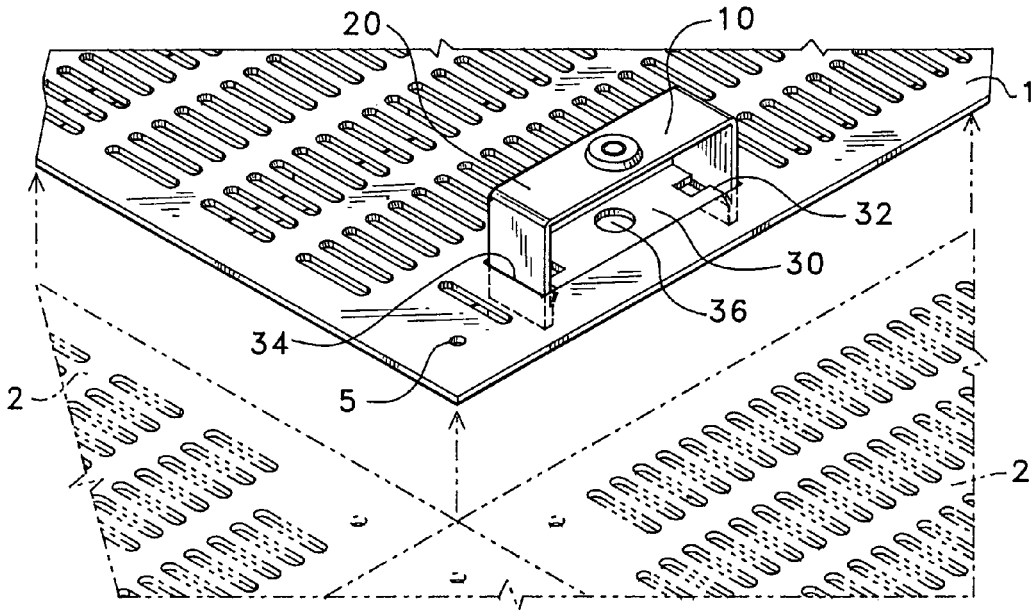
FIG. 5 is an exploded view of the panel lifter in a raised unlocked position in relation to other panels to form a raised floor matrix.

Turning now to FIG. 5, where it is shown an exploded view of the panel lifter 10 in a raised unlocked position relative to the other panels 2 previously installed to form a raised floor matrix. In the raised position, the stops 15 on the side wall ends 13, 14 engage a bottom plate 30 so that the panel lifter 10 does not slide out of the first 32 and second 34 slots in the plate 30.

Figure 6:
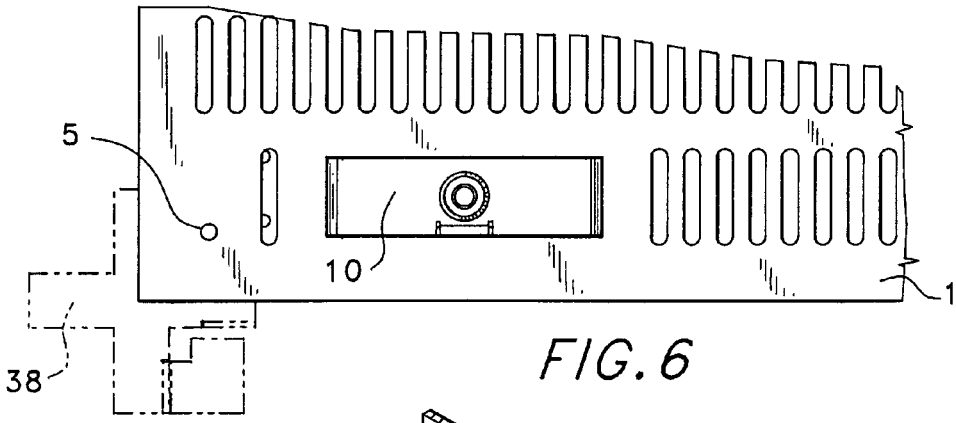
FIG. 6 is a top view of the panel lifter in a locked position showing the position of the panel leveler mechanism in relationship to the pedestal head.
Figure 7:
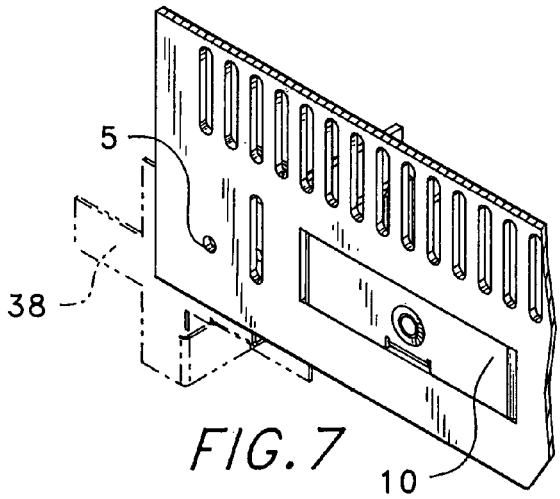
FIG. 7 is a perspective view of the illustration of FIG. 6.
Figure 8:
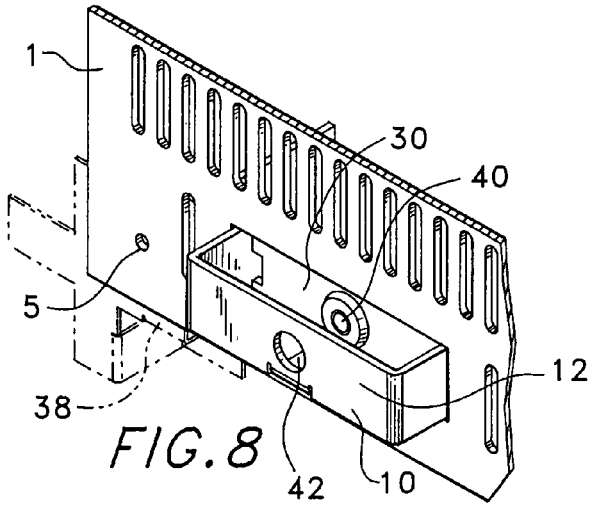
FIG. 8 is a perspective view of the illustration of FIG. 7, but further showing the panel lifter in an open and unlocked position.

FIGS. 6, and 7 show a top and perspective view, respectively, of the panel lifter 10 in a locked position and the location of the panel levelers 5 in relationship to the adjustable pedestal head 38. FIG. 8 shows a perspective view of the plate 30 and a second embodiment of the locking mechanism 40, but shows the panel lifter 10 in an open and unlocked position.

The second embodiment of the locking mechanism and a preferred embodiment of the adjustable corner lock are illustrated in FIGS. 9, 10, 11, and 12. Here, the lock 40 is centrally mounted in the plate 30 with a hole 42 in the top plate 12 for key insertion. The hole 42 also serves as a finger grip for lifting the panel lifter 10 in an upward direction. In the plate 30, a third slot 46 is provided for receiving a latch member 44 attached to the underside of the top wall 12 of the panel lifter 10. Also attached to the underside of the plate 30 is a ninety degree angle bracket 45 for pivotal attachment of a lever arm 50 at a pivot point 54 on the angle bracket 45. At a first end 53 of the lever arm 50 is a cylindrical threaded housing 56 for adjustably receiving a threaded corner lock 58.

Figure 9:
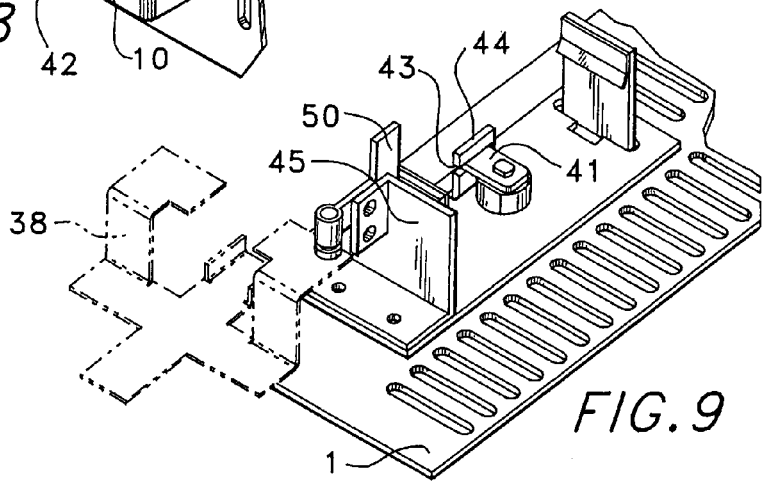
FIG. 9 is a perspective view of the underside of the panel lifter showing a second embodiment of the panel lifter locking mechanism and an adjustable corner lock.
Figure 10:
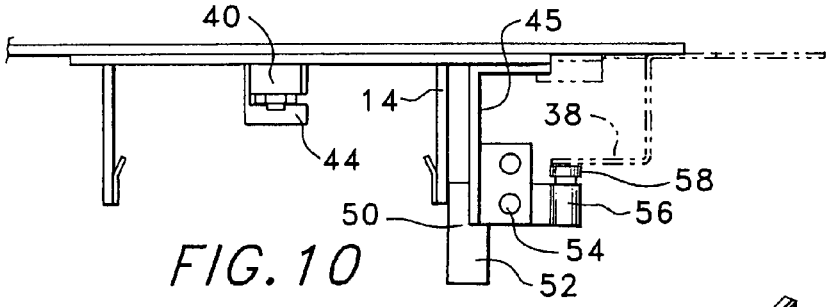
FIG. 10 is a side view of the perspective view shown in FIG. 9.
Figure 11:
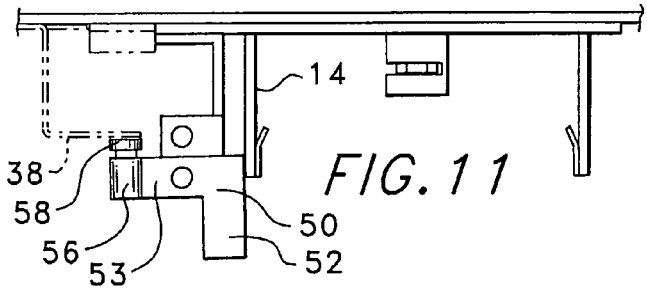
FIG. 11 is an opposite side view from view shown in FIG. 10.

As shown in FIGS. 9, 10, and 11, when the tab 41 on the lock 40 of the second embodiment is turned into a slot 46 in the latch 44 the top wall 12 of the panel lifter is recessed into the panel so as to provide a flush panel load supporting surface for rolling, sliding or walking. In this locked position, the side walls 13, 14 of the panel lifter 12 engage the second end 52 of the lever arm 50 downwardly forcing the lever arm 50 to pivot on the angle bracket 45 and the corner lock 58 to bias forcefully against the adjustable pedestal support 38 to anchor, and if desired, lock the panel in place to provide a secure enclosed environment.

Figure 12:
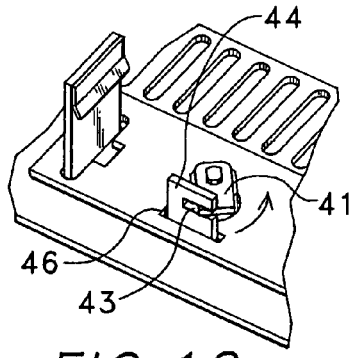
FIG. 12 is an underside perspective view of the second embodiment for the locking mechanism showing the lock releasing from a latch.
Figure 13:
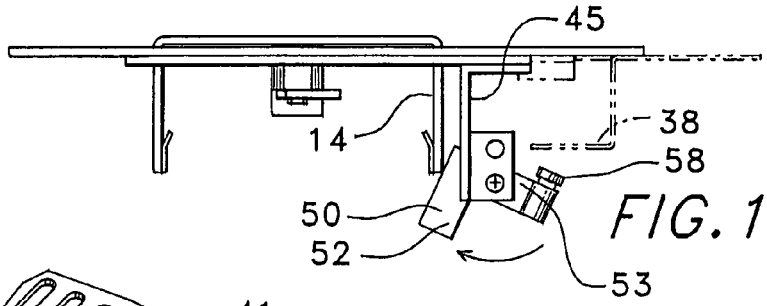
FIG. 13 is a side view of the panel lifter moving upwardly to disengage the corner lock.
Figure 14:
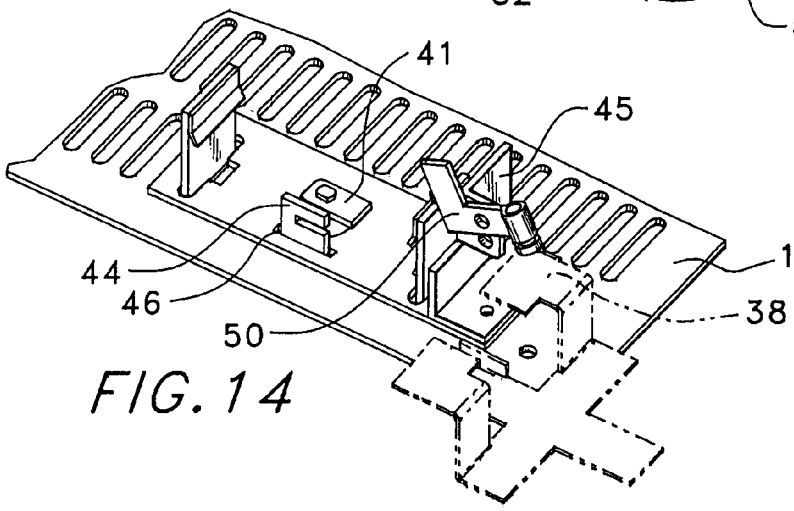
FIG. 14 is an underside perspective view of the illustration in FIG. 13.
Figure 15:
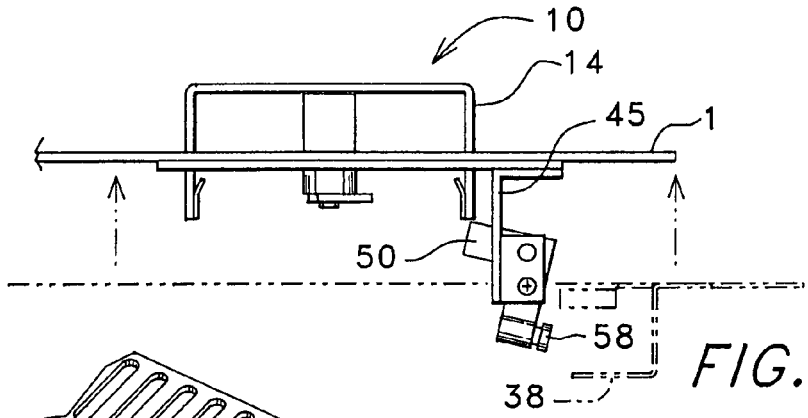
FIG. 15 is a side view of the panel lifter in a raised position with the corner lock fully disengaged from the pedestal.
Figure 16:
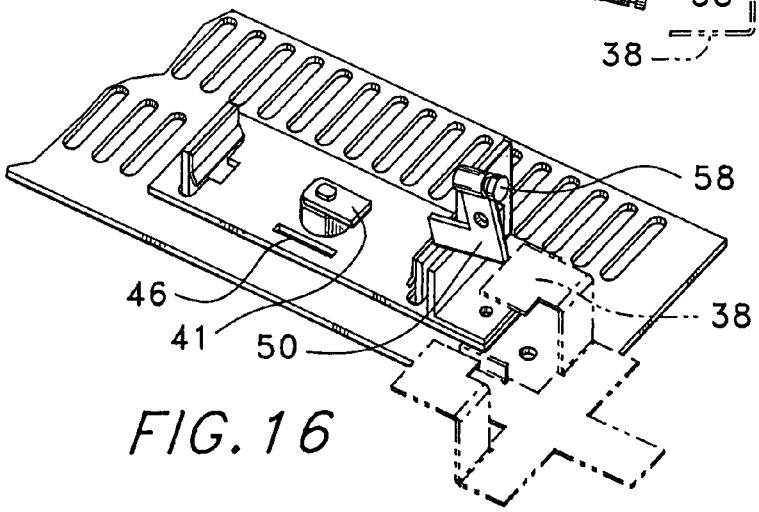
FIG. 16 is an underside perspective view of the illustration in FIG. 15.
Figure 17:
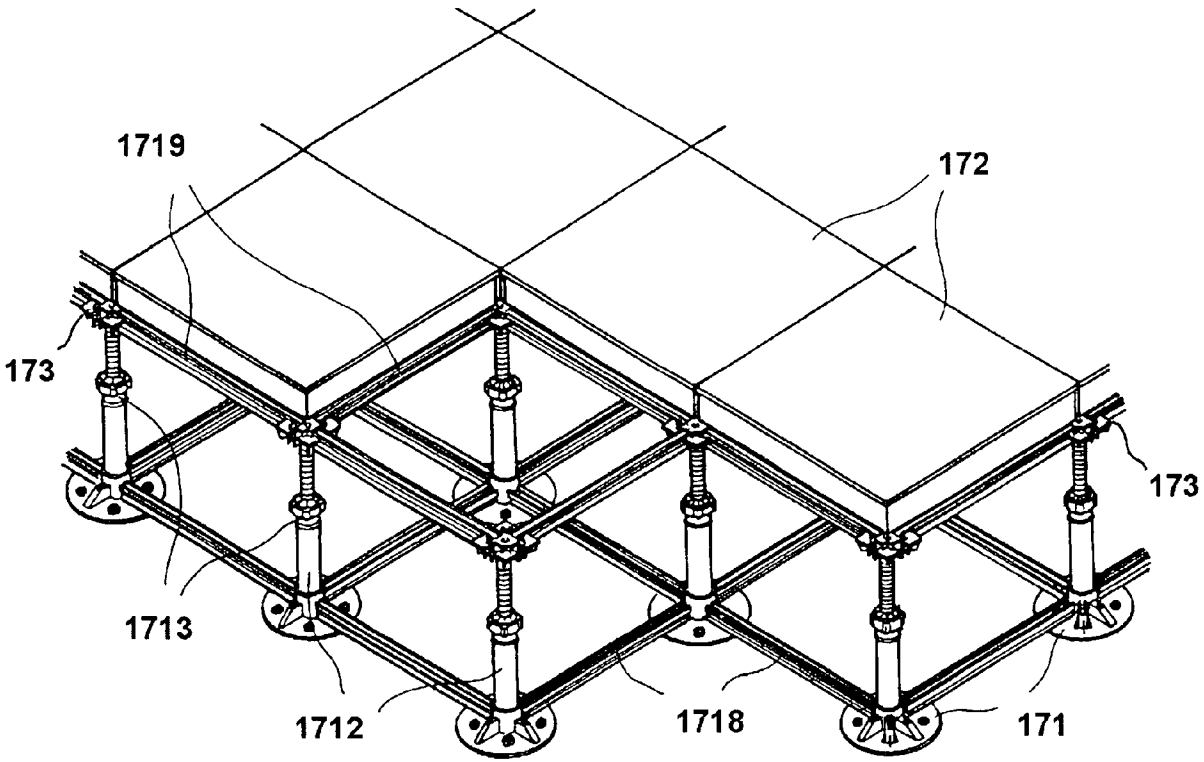
FIG. 17 (Prior Art)
FIG. 17 is a perspective view of the prior art.

The force of the corner lock 58 against the pedestal member 38 is easily withdrawn for removal of the panel 1. FIG. 12 shows an underside perspective view of the second embodiment of the locking mechanism showing the locking tab 41 releasing from the latch 44. To remove the panel 1 from the pedestal 38 one turns the key lock an urges the panel lifter 10 in an upward direction. As shown in FIGS. 13 and 14, as the panel lifter 10 is urged upward, a side wall 14 of the panel lifter 10 releases a tension on the lever arm second end 52 whereby the lever arm first end 53 and corner lock 58 pivot away from the pedestal support 38. In FIGS. 1, 5 and 16 the panel lifter 10 is shown in a fully raised position for removing the panel 1 and the corner lock 58 has fully released from the underside of a two tier adjustable support 38.

While the present invention has been described in connection with the illustrated embodiments, it will be appreciated and understood that modifications may be made without departing, from the true spirit and scope of the invention.

I claim:

1. In combination with a pedestal support system having a plurality of vertically extending pedestal supports each having an upper end connected to a pedestal support head and a lower end connected to a pedestal support base, the pedestal support heads each connected in a matrix orientation with a plurality of horizontal stringers, an integrated leveling raised access floor panel, comprising:

(a) a floor panel plate having four corner portions defined by four lateral edges, an upper load bearing surface, a lower surface, and a threaded clear hole connection disposed at each of the corners adapted to threadably engage a panel leveler; and (b) wherein the panel leveler includes a tool receiving end and a foot end, wherein the tool receiving end is capable of operable rotation of the leveler through the upper surface of the floor panel plate so that the foot end is capable of biasing downwardly against the pedestal head to establish a predetermined spaced relationship between the lower surface and the pedestal head and wherein the leveler does not fasten or attach the plate to the pedestal support system.

2. The raised access floor panel according to claim 1 wherein the panel leveler is a set screw.

3. The raised access floor panel according to claim 2 wherein the set screw includes an upper hex head tool receiving end.

4. The raised access floor panel according to claim 2 wherein the set screw further comprises a lower-flanged-end adapted to bias against, but not fasten or attach to, the pedestal head.

5. The raised access floor panel according to claim 2 wherein the threaded connection is a clear hole through the plate and an internally threaded collar connected, in axial alignment with the clear hole, to the lower surface.

6. The raised floor panel according to claim 1, wherein the floor panel plate further comprises at least one handle movably connected to the floor panel plate positioned adjacent to at least one of the lateral edge portions, the handle having a substantially rectangular top plate, and two opposing vertical side plates, the top plate having a thickness substantially equal to the floor panel plate thickness and a cut-out portion in order to lift the handle, the side plates each having an upper portion connected to the top plate and a lower portion engaging a lug to secure the lower portion against the lower surface of the floor panel when the handle is operated upwardly in a lifting position, and a substantially rectangular clear hole in the floor panel positioned in order to receive the handle top plate when the handle is operated downwardly in a position wherein the top plate is planar to the upper surface of the floor panel so that the upper load bearing surface is capable of plainer alignment with a raised floor.

7. A raised floor system, comprising a matrix of raised floor panels supported on a pedestal support system in a substantially horizontal plane, the support system including a plurality of vertically-extending pedestal support members, each of the support members having an upper pedestal support head, connected to a horizontal stringer, and a lower pedestal support base, connected to a subfloor of a building structure, and at least one floor panel plate having four corner portions defined by four lateral edges, an upper load bearing surface, a lower surface, and a threaded clear hole connection at each of the corners adapted to threadably engage a panel leveler including a tool receiving end, capable of operable adjustment of the panel leveler through the upper surface of the floor panel plate, so that the leveler rotates to bias downwardly against the pedestal head so that a predetermined distance is established between the panel lower surface and the pedestal head, and wherein the leveler does not fasten or attach to the pedestal support, pedestal base, or pedestal head.

8. The raised floor according to claim 7 wherein the threaded connection includes a collar disposed in axial alignment with the clear hole and the panel leveler is adapted to threadably engages the collar.

9. The raised floor according to claim 7 wherein the foot end further includes a flange biasing downwardly against the pedestal head.

10. The raised floor according to claim 7 wherein the panel leveler is a set screw.

11. The raised floor system according to claim 7, wherein the floor panel plate further comprises at least one handle movably connected to the floor panel plate positioned adjacent to at least one of the lateral edge portions, the handle having a substantially rectangular top plate, and two opposing vertical side plates, the top plate having a thickness substantially equal to the floor panel plate thickness and a cut-out portion in order to lift the handle, the side plates each having an upper portion connected to the top plate and a lower portion engaging a lug to secure the lower portion against the lower surface of the floor panel when the handle is operated upwardly in a lifting position, and a substantially rectangular clear hole in the floor panel positioned in order to receive the handle top plate when the handle is operated downwardly in a position wherein the top plate is planar to the upper surface of the floor panel so that the upper load bearing surface is capable of plainer alignment with the horizontal plane.

* * * * *